United States Patent [19]

Pfuhl

[11] 4,240,367

[45] Dec. 23, 1980

[54] SEWING AID DEVICE

[75] Inventor: Jakob Pfuhl, Punchbowl, Australia

[73] Assignees: Katharina Pfuhl; Ingrid Pfuhl; Kate Models Pty., Limited, all of Punchbowl, Australia

[21] Appl. No.: 498,948

[22] Filed: Aug. 20, 1974

[30] Foreign Application Priority Data

Aug. 27, 1973 [AU] Australia ..... PB4645

[51] Int. Cl.[2] ..... D05B 35/00

[52] U.S. Cl. ..... 112/148

[58] Field of Search ..... 112/148, 151, 152, 153

[56] References Cited

U.S. PATENT DOCUMENTS

| | | | |
|---|---|---|---|
| 2,094,528 | 9/1937 | Daughters | 112/121.12 |
| 2,355,023 | 8/1944 | Wiren | 112/121.12 |
| 2,826,158 | 3/1958 | Phillips | 112/121.15 |
| 3,749,038 | 7/1973 | Dodsworth | 112/121.15 |
| 3,870,000 | 3/1975 | Ferre et al. | 112/121.15 |

FOREIGN PATENT DOCUMENTS

| | | | |
|---|---|---|---|
| 482277 | 6/1953 | Italy | 112/121.15 |

*Primary Examiner*—George H. Krizmanich

*Attorney, Agent, or Firm*—Irving M. Weiner; Pamela S. Burt; John L. Shortley

[57] ABSTRACT

A sewing aid device, particularly for inserting slide fasteners, collars, sleeves and the like into partly-finished garments, comprises a frame in which the materials to be sewn together are held in fixed relative position. A guideway on the frame cooperates with corresponding means on a sewing machine foot so that the machine sews around the guide without the need for constant operator adjustment.

1 Claim, 25 Drawing Figures

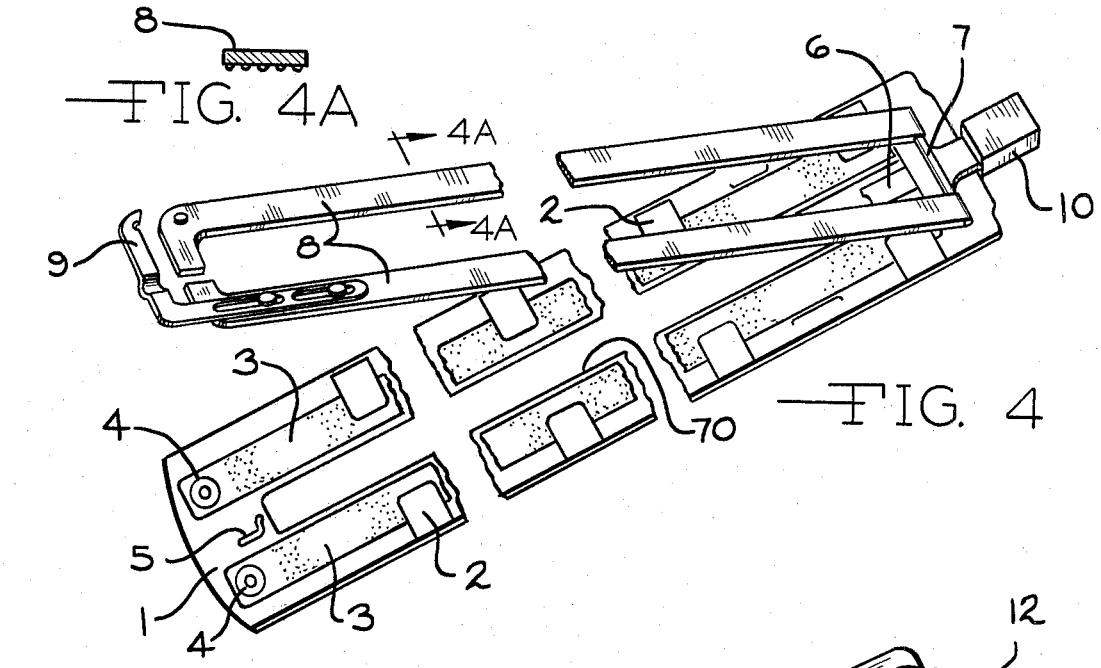
FIG. 4A
FIG. 4
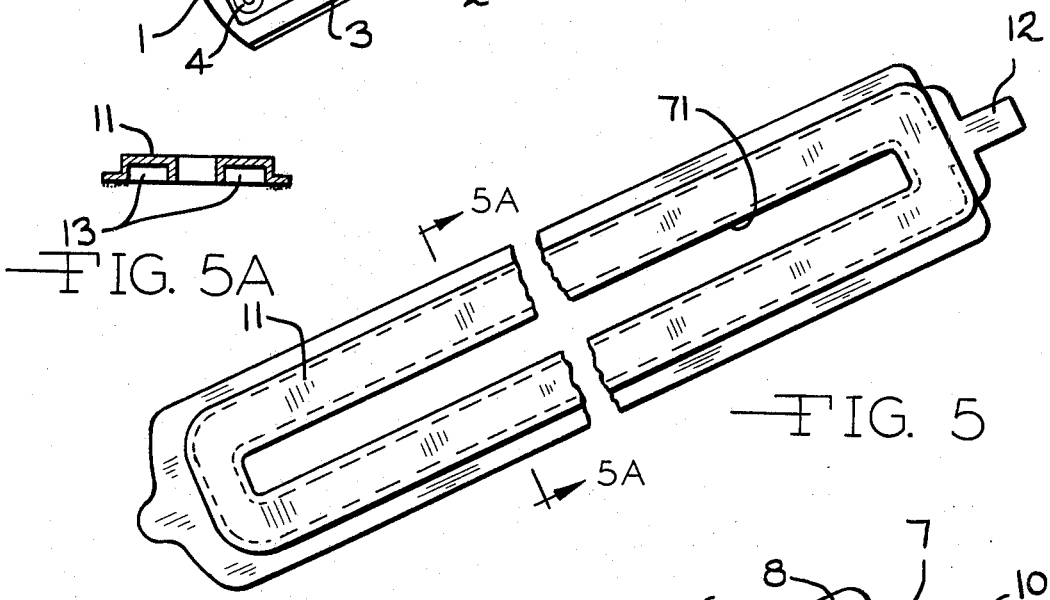
FIG. 5A
FIG. 5
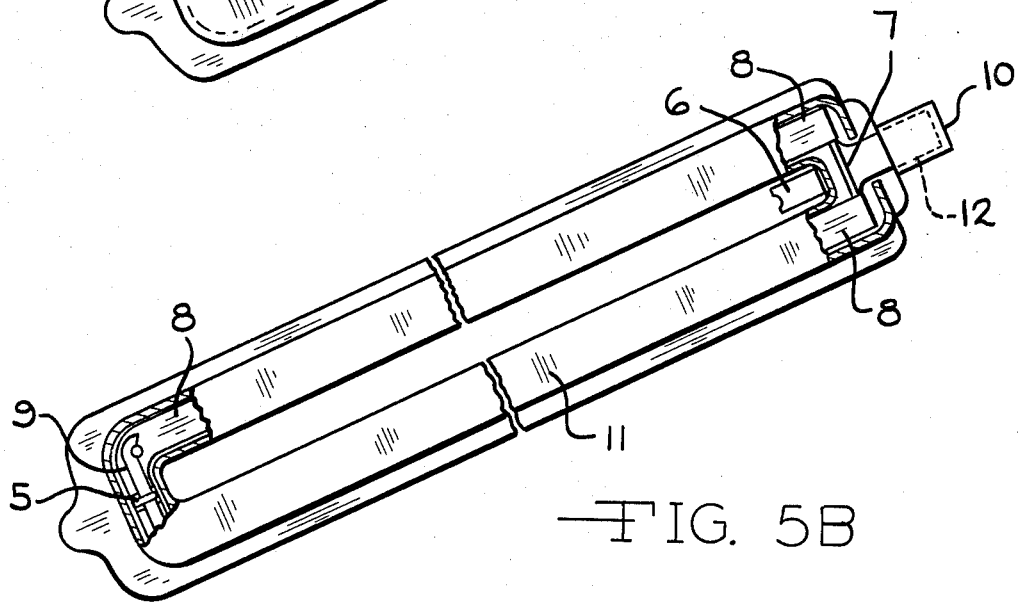
FIG. 5B

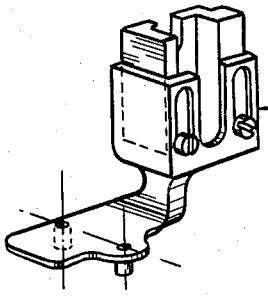
FIG 6
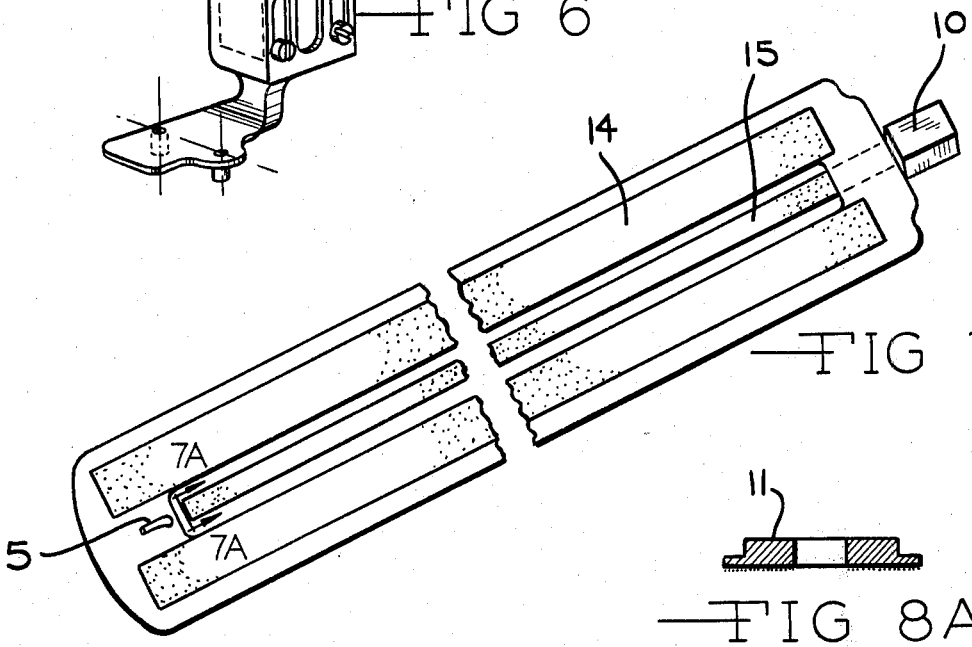
FIG 7
FIG 8A
FIG 7A
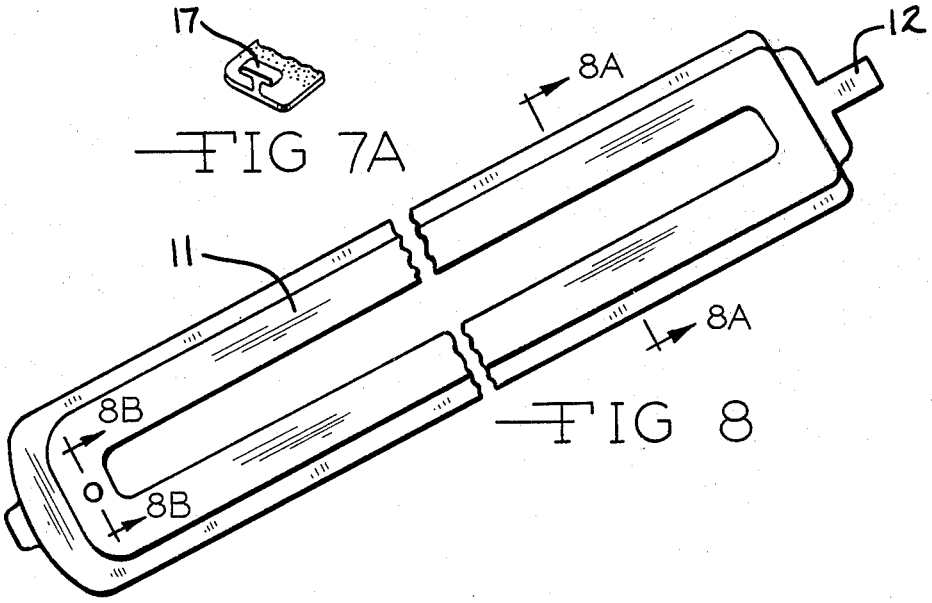
FIG 8
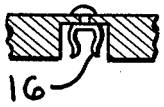
FIG 8B

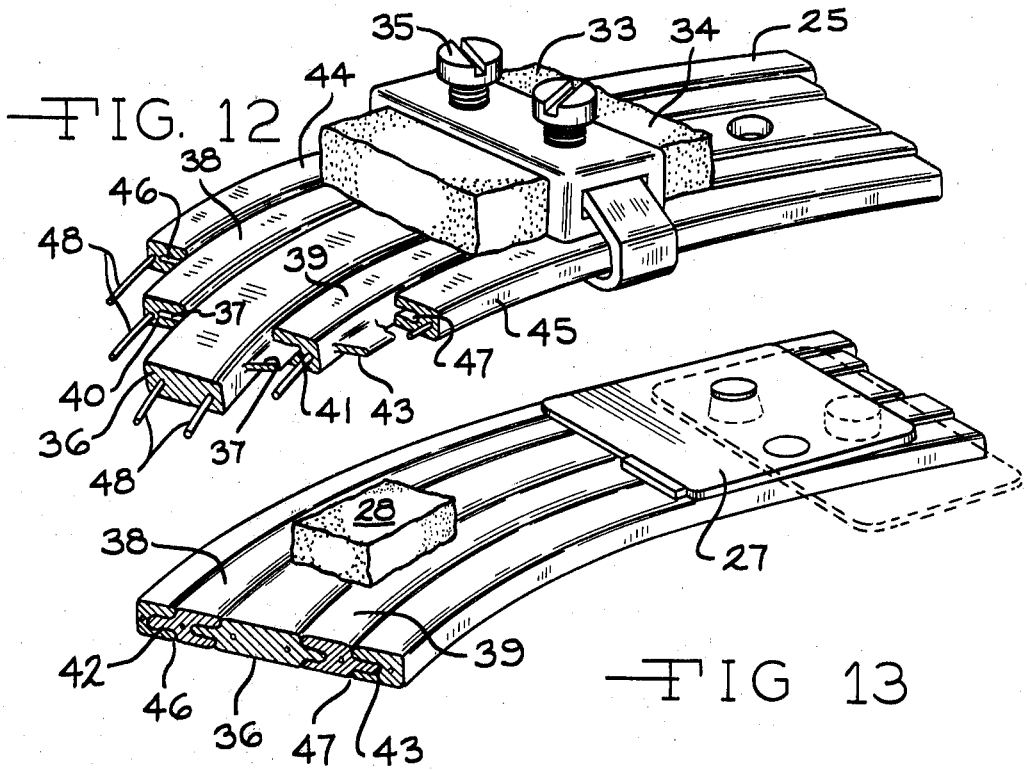
FIG. 12
FIG 13
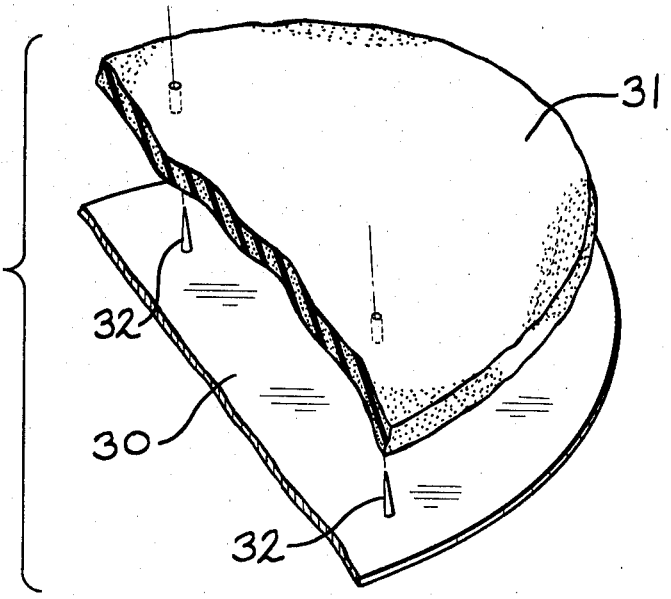
FIG 14

SEWING AID DEVICE

This invention relates to sewing equipment and in particular to means adapted to facilitate the insertion of items into partly-made garments, such as, for example, slide fasteners, pockets, collars, and the like. The invention is not limited to garment manufacture however, but finds use in, for example, the leather trade, millinery manufacture, etc.

The making up of garments, particularly by mass production methods, encounters certain problems during the insertion of items such as slide fasteners, pockets, collars, etc., which are time-consuming and therefore expensive, and also affect the uniformity and quality of the finished product. Thus, for example, the customary manner of inserting a slide fastener into a partly-finished garment requires the fabric edging of the fastener to be hand-tacked or hand-basted to the garment in the required position, after which the fastener is permanently stitched in position by machining. Not only is the hand-basting operation time-consuming, but so is the machining step which requires constant attention and readjustment on the part of the operator if an even stitching is to be obtained. Thus, not only is there a considerable time consumption, but operating staff need to be highly skilled and experienced if good quality work is to be obtained. A further problem encountered, for example, during the production and insertion of pockets, collars, etc., is that it is very difficult to obtain exact duplication of such items with consequent lack of symmetry between pockets on opposite sides of a garment, or lack of uniformity between two separate garments which are intended to be identical.

It has been proposed to use metal templates for the production of pockets, collars, etc. which templates guide machine sewing operations precisely, enabling exact duplication of such items. However, such templates have to be specially manufactured and are expensive. In the fashion trade particularly, such a template might be useful for only a short period before the fashion changed, requiring the production of a different template, and so on, thereby greatly escalating the costs of manufacture.

According to the present invention there is provided a sewing aid device comprising frame means adapted to hold in fixed relative position items to be stitched together, and provided with guide means adapted to engage with cooperating guide means on a sewing machine in such manner as to permit automatic guiding of the sewing mechanism of the sewing machine along the guide means on the frame.

The device of the present invention may be adapted in a variety of ways for use in different sewing operations, such as the insertion of slide fasteners, collar or pocket manufacture, sleeve insertion and the like. Devices according to the invention may be adapted for commercial or domestic use and may be constructed in a number of ways.

Various embodiments of the invention are illustrated by way of non-limiting example in the attached FIGS. 1 to 16 in which:

BRIEF DESCRIPTION OF THE DRAWINGS

FIG. 4 illustrates the lower portion of frame means according to one embodiment of the present invention;

FIG. 4*a* illustrates a cross-section through a part of such frame means portion;

FIG. 5 illustrates the upper portion of frame means adapted to cooperate the portion illustrated in FIG. 4;

FIG. 5*a* illustrates a cross-section through part of such upper portion;

FIG. 5*b* illustrates the cooperation between the lower portion of frame means illustrated in FIG. 4 and the upper portion of frame means illustrated in FIG. 5;

FIG. 6 illustrates a further sewing machine pressure foot adapted for use with the present invention;

FIG. 7 illustrates the lower portion of frame means according to a further embodiment of the invention;

FIG. 8 illustrates the upper portion of frame means adapted to cooperate with the portion illustrated in FIG. 7;

FIG. 8*a* is a cross-sectional view of the upper portion of the frame means, taken along line 8A-8A in FIG. 8.

FIG. 8*b* is a view taken along line 8B-8B in FIG. 8.

FIG. 12 illustrates a stop device adapted for use with the frame of FIG. 11;

FIG. 13 illustrates a detail of the frame shown in FIG. 11;

FIG. 14 illustrates part of a filling device for use with the frame of FIG. 11;

DETAILED DESCRIPTION

With further reference to the drawings, FIGS. 4 and 5 represent a particular form of frame means adapted to be used for the insertion of slide fasteners into partly-made garments. Such frame comprises an upper part and a lower part illustrated in FIGS. 4 and 5, respectively.

Figure 3:
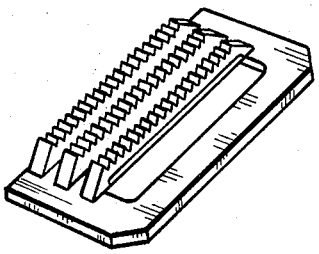
FIG. 3 illustrates a sewing machine feed dog adapted for use with the present invention.

The lower part comprises a base 1, the under surface of which is preferably made of soft material, for example, rubber, for engagement with the feed dog mechanism (FIG. 3) of a sewing machine. The upper surface of base 1 is of rougher texture to prevent the slipping of fabric placed thereon.

The base 1 has a central aperture 70 and is provided with a series of leaf spring clips 2 along both sides. A pair of pivotable thin metal leaves 3 is fixed to the base 1 at pivot points 4 in such manner that they may be swung into or away from engagement under the spring clips 2. Hook 5 is located towards one end of the base 1 and a guide member 6 is provided at the other end. An axle 7 is located at the same end of the base 1 as the guide members 6, and a two-part holder member 8 is hinged on the axle 7. The under-surface of member 8 is of roughened configuration, as shown in FIG. 4*a*, to prevent slipping of fabric held thereby. In the closed position the holder member 8 is hinged downwardly onto the base 1 and is secured thereto by means of member 9. The member 9, when moved to the right, is caused, at its depressed central portion, to engage under the hook 5 while its outer extremities fit over the ends of the two parts of member 8 thereby holding member 8 securely onto base 1. Finally, the base 1 is provided with a leaf-spring mechanism 10 adapted to receive the end of the upper frame part shown in FIG. 5 and to allow for the reception of materials of different thicknesses.

The upper frame part is provided with a central aperture 71 corresponding to the aperture 70 of the lower part and is provided on its upper surface with a guide 11 surrounding the aperture 71 and for the purpose of guiding the pressure foot of a sewing machine. Guide 11 is formed smooth, while the under surface of the upper part is preferably roughened as shown in FIG. 5*a* to prevent slipping of material in contact therewith. The upper part is formed with a tongue 12 adapted to fit into spring mechanism 10, and is also provided with channels 13 in its lower surface adapted to fit tightly over the holder member 8 of the lower frame part. Thus, the upper part may be fitted to the lower part by inserting tongue 12 into spring mechanism 10 and pressing down so that channels 13 fit closely over holder member 8.

In use, a slide fastener to be inserted into a partly finished garment is placed into the lower part of the frame by engaging one end of the fastener over hook 5 and engaging the other end by means of the guide member 6 and slipping the edges of the fabric of the slide fastener under spring clips 2. Leaves 3 are then swung also under clips 2 to hold the fastener in position. The sides of the slit or placket of a garment into which it is desired to stitch the slide fastener are then placed over the fastener in the desired position to be stitched. In the case, for example, of a slide fastener to be inserted with a "one-side overlap", the right-hand side of the material is pressed, without stretching, over the right-hand edge of the fastener close up to the fastener teeth. The right-hand part of holder member 8 is then pivoted downwardly to hold such material in place. The left side of the material is then pressed, without stretching, over the slide fastener and over the right-hand side of the material and the left-hand part of holder member 8 is then pressed down over the material and the member is locked into position by engaging catch mechanism 9 under the hook 5.

Figure 1A:
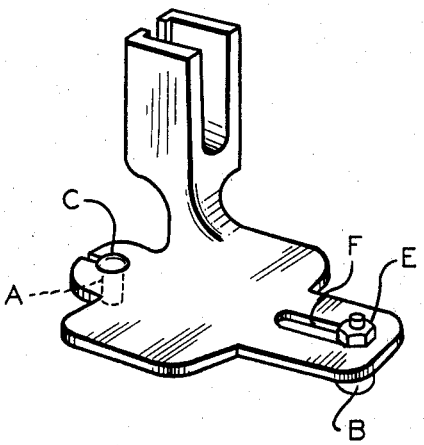
FIG. 1*a* illustrates a sewing machine pressure foot adapted for use with the present invention.

The upper frame part is then pressed on to the lower part as described above and in this position the slide and material will be held firmly into the desired position for stitching. The assembly is then placed on a machine, and the fastener stitched in using a pressure foot of the type illustrated in FIG. 1, guide lugs A and B fitting over raised guide portion 11 of the upper frame part. Lug B may be rotatable, although lug A is fixed because of the cotton-introducing slot as shown in the drawing. Lug B may also be spring-loaded if desired. The left-hand side of the material is lifted up and placed over a material-lifting raised portion C on the pressure foot (FIG. 1*a*) and the stitching operation is commenced down the right-hand side of the fastener. As the pressure foot reaches the end of the guide, and thus the bottom of the fastener, the material slips off the raised portion C. The frame is half-turned so that stitching proceeds straight across the end of the guide, and the bottom of the fastener, when it is again half-turned so that the stitching continues up the left-hand side of the fastener. In this way the slide fastener may be stitched accurately by unskilled machine operators, the pressure foot being guided by the frame portion down one side, across the bottom, and up the other side in one operation without requiring any adjustment of the fastener or material on the part of the machine operator. A further advantage is that in such arrangement the feed dog mechanism of the machine does not contact the material itself, but rather engages the underside of the frame, thereby avoiding any stretching or puckering of the material during the machining operation.

Figure 1B:
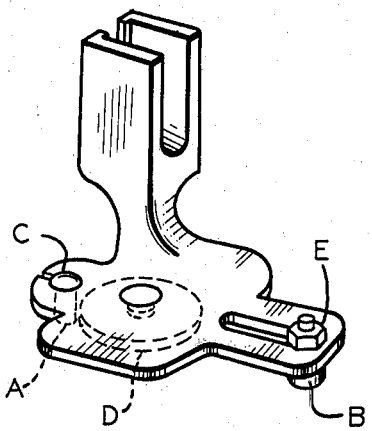
FIG. 1*b* illustrates a modification of the foot shown in FIG. 1*a*.
Figure 2:
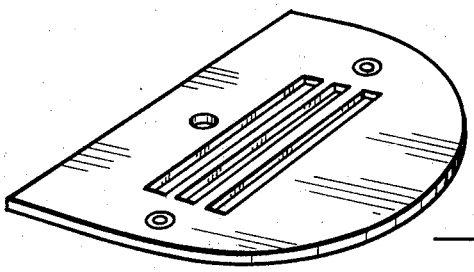
FIG. 2 illustrates a sewing machine needle plate adapted for use with the present invention.

The pressure foot of FIG. 1*b* is additionally provided with a rotatable guide member D which assists pressure foot around the corners of the guide 11.

The pressure foot (FIGS. 1*a* and 1*b*) can be adjusted to the width of the guide 11 by movement of lug B in slot F after loosening nut E.

The pressure foot illustrated in FIG. 6 is particularly suitable for the sewing of slide fasteners into garments with side flaps overlapping in the center of the fastener. In this case no raised portion C is required to lift the overlapping material portion as in the example just described with reference to FIGS. 1*a* and 1*b*.

A further embodiment of the invention, also adapted for the insertion of slide fasteners, is illustrated in FIGS. 7 and 8. This embodiment is of a somewhat simplified design adapted for use on domestic sewing machines rather than commercial mass-production machines. Instead of the spring clips 2 previously described, this embodiment is provided with an adhesive cloth 14 for holding the slide fastener and the material in position. A modified slide fastener guide 15 is also provided.

In this embodiment, a slide fastener is again engaged over hook 5 and section 17 and along guide member 15 with the fabric of the fastener pressed onto the adhesive surface 14 which holds it firmly in position. The sides of the garment are then placed over the fastener, and are also held by the adhesive surface (which is wider than the fastener fabric) and the upper portion (FIG. 8) is fitted onto the base by engaging the tongue 12 in spring mechanism 10 and pressing down to engage spring clip 16 (FIG. 8*b*) over the hook 5 on the base. In this case the underside of the upper part is not channelled, but is roughened (FIG. 8*a*) to prevent the fabric slipping. The assembly is then inserted, as before, into a machine for stitching along the guide 11.

Figure 9:
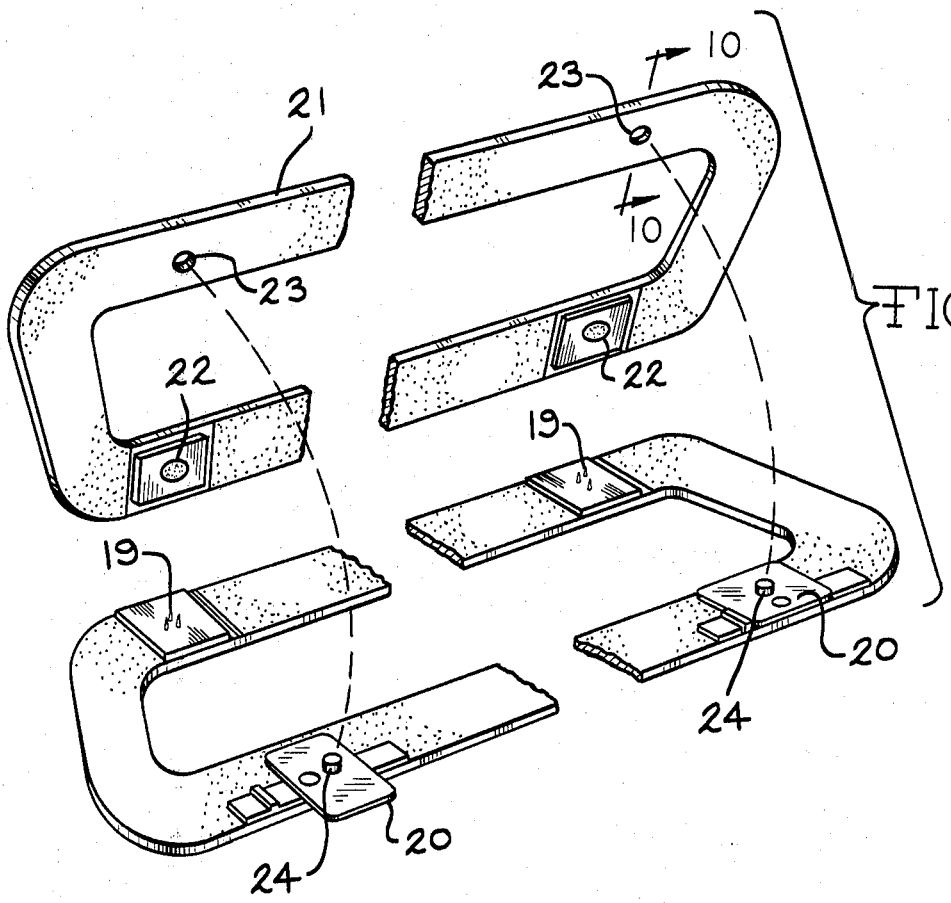
FIG. 9 illustrates the lower portion of frame means according to a still further embodiment of the invention.
Figure 10:
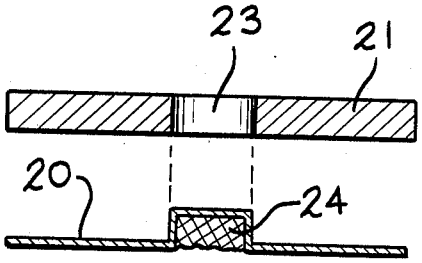
FIG. 10 illustrates a section along the line X-X of FIG. 9.

A still further embodiment, suitable for duplicating standard pieces such as collars, is illustrated in FIGS. 9 and 10. In this embodiment a base 18, preferably of rigid material such as metal or rigid plastic is provided with a series of pin members 19 and pivotable clips 20. An upper part 21 is adapted to fit closely over the base 18, and forms the guide surface for subsequent machining. The upper part 21 is provided with pads 22 of soft rubber or plastic into which pins 19 engage, and also holes 23 which fit closely around the lugs 24 on clips 20 as shown in greater detail in FIG. 10. In use, the edges of two pieces of fabric to be stitched together, e.g., to form a collar, are engaged under clips 20 and over pins 19, and clips 20 are then swung to the closed position to hold the fabric edges engaged thereby. The upper part 21 is then fitted on to the base 18 to hold the fabric tightly in position, after which the assembly may be placed in a machine for stitching as before, the upper part 21 forming the guide engaged by the machine pressure foot as already described. In addition to the material pieces to be stitched together, filler material can be incorporated between such material pieces if desired to provide separation of the pieces or bulkiness if desired.

Figure 11:
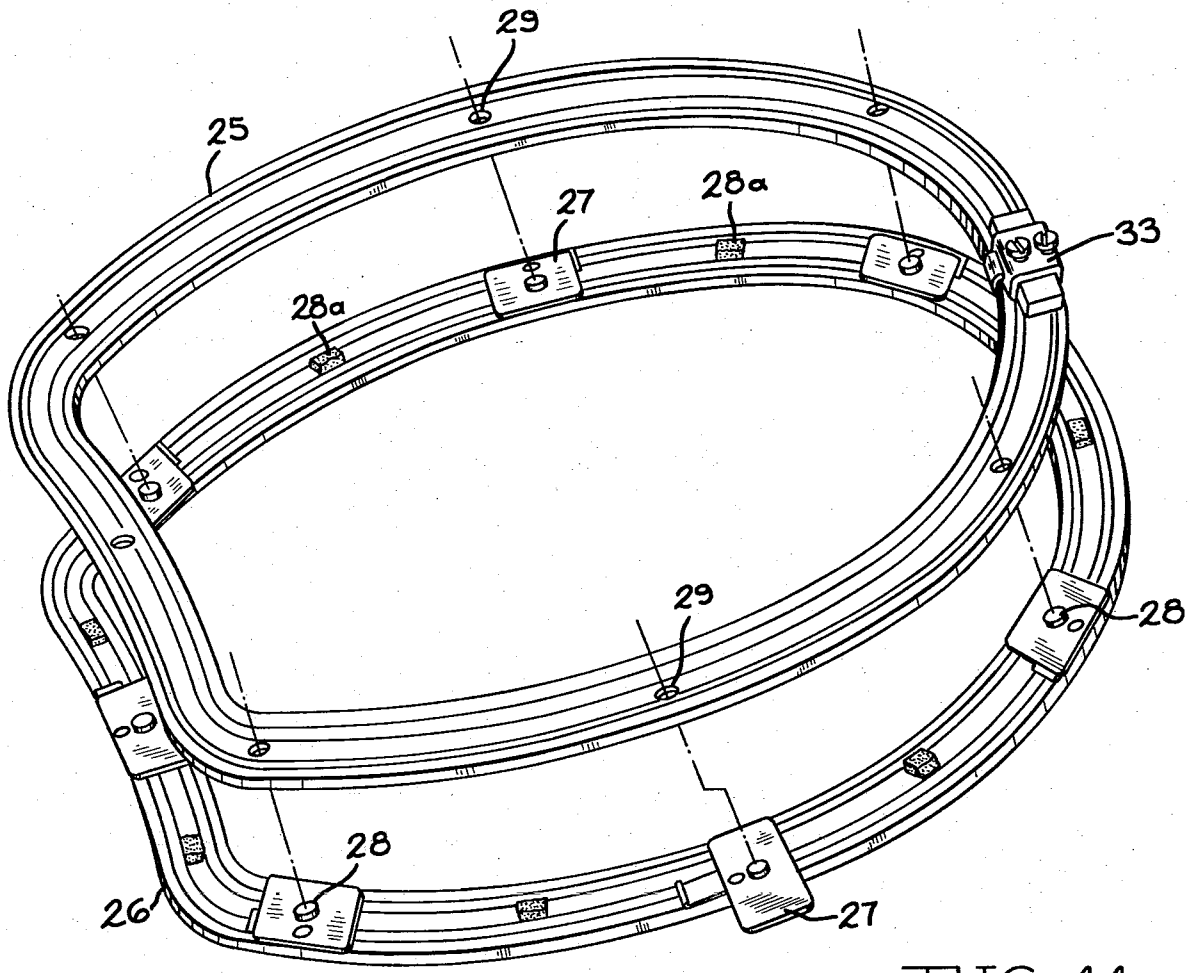
FIG. 11 illustrates frame means according to a still further embodiment of the invention.

A yet further embodiment of the invention is illustrated in FIG. 11, which embodiment is adapted for contoured or profiled stitching as, for example, the manufacture of pockets. This embodiment is particularly designed for shape modification by the user as desired.

As in the embodiments previously described, the frame comprises upper and lower parts 25 and 26, respectively. The lower part 26 is provided with pivotable clips 27 and also friction pads 28*a* which may be made, for example, from soft foam plastic or the like, and which serve as guides. Clips 27 are provided with upwardly-extending lugs 28 which fit closely into holes 29 provided in the upper part 25.

Again, two pieces of fabric to be stitched together are held between the two parts 25 and 26, the facing surfaces of which are formed rough. The edges of the pieces are fitted under clips 27 when the parts 25 and 26 are in the open position. The parts 25 and 26 are then swung to the closed position, and the upper part 25 is fitted onto the base and the assembly is ready for machining as before.

A portion of a suitable filler is illustrated in FIG. 14, comprising a bottom piece 30 of cardboard, etc., and a soft upper piece 31 of foam plastics, etc., which is held onto the bottom 30 by engagement with pins 32.

In the manufacture of pockets etc. it will be necessary to turn the stitched pieces inside-out to conceal the seam and it is then necessary not to stitch completely around the article, but to leave a gap in the stitching for this purpose. This may be done conveniently by providing the upper part 25 with a stop device 33, which is shown in FIGS. 11 and 12 and which comprises a resilient buffer 34 secured to part upper 25 by screws 35. Machining is commenced at one side of the buffer 34 and is continued around the frame until the pressure foot reaches the other side of the buffer 34, thereby leaving a stitching gap having a width equal to the width of the stop device 33.

It is a feature of the frame arrangement illustrated in FIGS. 11 to 13 that it may be made up inexpensively, and bent to shape as required by the user in accordance with changing fashions, etc. Such frames may conveniently be made from flexible material, such as plastic, rubber, or metal, in such manner as to permit bending either manually or by means of a mechanical bending device.

One method of frame construction is illustrated in detail in FIGS. 12 and 13. Such frame is formed from a number of tongued and grooved strips of plastic materials which are fitted together longitudinally, joined together at the ends by any suitable means, in this instance the stop 33, and subsequently formed into the desired shape.

In the embodiment illustrated, the frame comprises five strips 44, 38, 36, 39 and 45, the central strip 36 being formed on each side with projecting tongues 37. The adjacent strips 38 and 39 are formed on one side with grooves 40 and 41, respectively, and on the other side with tongues 42 and 43, respectively. The outer strips 44 and 45 are provided on their inner side with grooves 46 and 47, respectively, while the outer edges are formed smooth. In each case the strips are reinforced with flexible wires 48. The central strip 36 is formed wider than the outer strips 44 and 45, which assists flexing and shaping of the assembled frame. Flexing may be readily accomplished, manually or mechanically, to provide a frame suitable for the manufacture of pockets, collars or other items of any desired shape. Also, the outermost strips 44 and 45 are preferably formed narrower than the next adjacent strips 38 and 39. As the frame is bent, the strips move relative to each other to permit stretching of the outer strips and compression of the inner strips.

Figures 15, 15A:
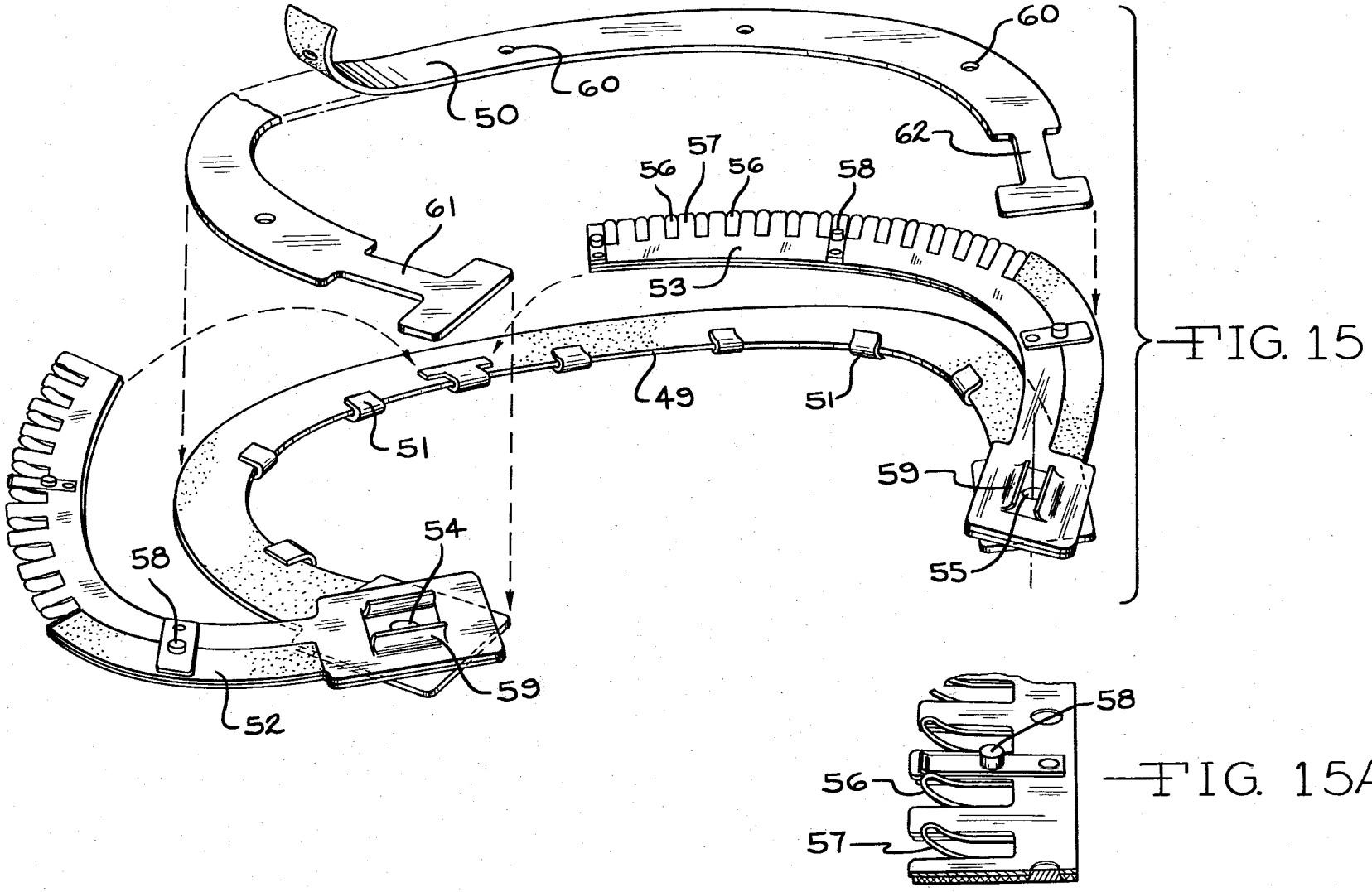
FIG. 15 illustrates frame means according to yet another embodiment of the invention.
FIG. 15*a* illustrates a detail of the frame of FIG. 15.

The embodiment illustrated in FIGS. 15 and 15*a* is particularly adapted for the insertion of sleeves into garments. The insertion of sleeves involves a problem in that the edge of sleeve material to be inserted is longer than the edge of the garment to which it is to be stitched. Therefore, the sleeve material has to be eased into the sleeve aperture in the garment, which requires considerable skill on the part of the machinist if this is to be achieved neatly and evenly.

The frame means illustrated in FIG. 15 is again formed in two flexible parts, namely, base 49 and upper part 50. Base 49 is provided with spring clips 51 along one edge, and at each extremity has pivotable members 52 and 53 pivoted thereto at points 54 and 55, respectively. Members 52 and 53 are provided with a series of spring loops 56 located in between tongues 57 (shown in greater detail in FIG. 15*a*), and also, at its upper surface, with a series of upstanding lugs 58. The ends of members 52 and 53 are provided with spaced flanges 59.

Upper part 50 corresponds in shape with base 49 and is provided with holes 60 corresponding to lugs 58 on the pivotable members 52 and 53. Upper part 50 has neck portions 61 and 62 adapted to fit between flanges 59 on members 52 and 53.

In use, the sleeve aperture edge of a garment is inserted under spring clips 51. Members 52 and 53 are then pivoted to close under clips 51 also, and thereby hold the garment edge firmly in position. The frame is sized according to the sleeve aperture desired, and in practice the frame is forced to curve upwardly as the garment edge is inserted because of its curvature.

The larger sleeve edge is then inserted under spring loops 56 and over tongues 57, thereby taking up the greater length relative to the garment edge.

Upper part 50 is then fitted over the assembled base 49 with necked portions 61 and 62 engaging between flanges 59, and holes 60 engaging lugs 58.

The assembly, which is now curved upwardly, is inserted in a machine as in previous embodiments, and is sewn by engagement of guide lugs A and B (FIG. 1) over upper part 50, stitching taking place along the outer edge of the curved guide.

Figure 16:
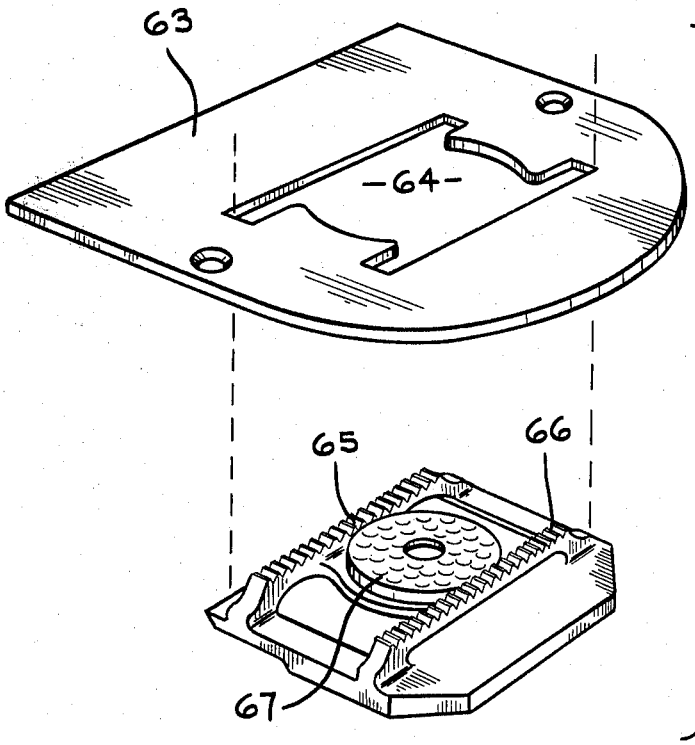
FIG. 16 illustrates an exploded fashion a foot plate and feed dog arrangement particularly adapted for use with the present invention.
Figure 16A:
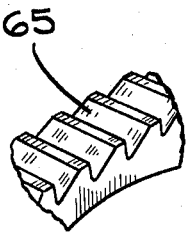
FIG. 16*a* illustrates an enlarged view of the feed dogs.

FIG. 16 represents a particular form of sewing machine foot plate and feed dog arrangement. A plate 63 is provided with an aperture 64 which is adapted to receive feed dogs 65 and 66*a* and rotatable, roughened disc 67. Disc 67 is particularly adapted to assist sewing around corners, especially corners of frames according to the present invention. A corresponding rotatable disc may also be provided on the pressure foot if desired.

The invention includes a method of sewing using the devices herein described.

The present invention provides a wide variety of simple guide means permitting sewing operations of the type described and be conducted without the need for skilled operators, and in a very much shorter time than that required by skilled operators using current conventional techniques.

Moreover, devices according to the invention permit, if desired, stitching around a complete circuit, repetitively if necessary, which is not possible with known arrangements, e.g. templates.

Finally, devices according to the invention can be made of lighter and cheaper materials than conventional templates, and can handle larger items to be sewn.

I claim:

1. A sewing aid device comprising:

frame means adapted to hold together in fixed relative position items to be stitched together, and provided with guide means in the form of a raised track adapted to engage with a foot mechanism on a sewing machine in such manner as to permit automatic guiding of the sewing pressure foot mechanism of the sewing machine along said guide means;

said frame means being adapted particularly for the insertion of slide fasteners into garments, comprising an elongated base member provided with a central aperture and with means for retaining a slide fastener thereon, means for holding portions of a garment in close proximity with the fastener, and said guide means in the form of a raised track for guiding a sewing pressure foot mechanism therealong;

the means for holding the garment comprising a two-part member hinged at one end to one end of said base and releasably securable to said base at the other end; and said guide means in the form of a raised track providing a smooth raised guideway above the level of the said two-part member of substantially constant width across which guide means on a sewing machine may fit closely in such manner as to be constrained to travel along said raised track guide means.

* * * * *